US005083711A

United States Patent [19]

Giroux et al.

[11] Patent Number: 5,083,711

[45] Date of Patent: Jan. 28, 1992

[54] ELECTRICAL INSULATOR DEVICE IN THE FORM OF A SECTION OF PIPE AND INSTALLATION COMPRISING SAME

[75] Inventors: Patrice Giroux, Saint Egreve; Jean C. Rey, Echirolles, both of France

[73] Assignee: Sames S.A., Meylan, France

[21] Appl. No.: 631,403

[22] Filed: Dec. 21, 1990

[30] Foreign Application Priority Data

Dec. 22, 1989 [FR] France ..... 89 17116

[51] Int. Cl.[5] ..... B05B 5/16

[52] U.S. Cl. ..... 239/690; 118/629; 361/228

[58] Field of Search ..... 239/690, 691; 361/227, 361/228; 118/621, 629

[56] References Cited

U.S. PATENT DOCUMENTS 4,629,119 12/1986 Plunkett et al. ..... 239/690
4,884,745 12/1989 Spongh ..... 239/691
4,884,752 12/1989 Plummer ..... 239/691
4,921,169 5/1990 Tilly ..... 239/690
4,932,589 6/1990 Diana ..... 239/691
4,962,724 10/1990 Prus et al. ..... 239/690
4,993,644 2/1991 Klemm ..... 239/690

FOREIGN PATENT DOCUMENTS 8705832 10/1987 PCT Int'l Appl. ..... 239/690

*Primary Examiner*—Andres Kashnikow
*Assistant Examiner*—Lesley D. Morris
*Attorney, Agent, or Firm*—Spensley Horn Jubas & Lubitz

[57] ABSTRACT

An electrical insulator device is in the form of a section of pipe for a conductive liquid. The device comprises an insulative casing accommodating a mobile assembly and an expandable pipe part is connected between one end of the casing and this mobile assembly, which carries ano-ring for scraping clean an end surface of a connection mechanism arranged in the vicinity of the second end of the casing, with which it cooperates.

23 Claims, 4 Drawing Sheets

ELECTRICAL INSULATOR DEVICE IN THE FORM OF A SECTION OF PIPE AND INSTALLATION COMPRISING SAME

BACKGROUND OF THE INVENTION

1. Field of the invention

The invention concerns an electrical insulator device in the form of a section of pipe for a circuit distributing a relatively good conductor liquid such as a water-based coating product; it is more particularly concerned with a device of this kind in which the electrical insulation is achieved by separating two parts of said pipe section. The invention also concerns an installation for distributing relatively good conductor liquid products incorporating a device of this kind, in particular an electrostatic coating product spraying installation.

2. Description of the prior art

In an installation for electrostatically spraying a relatively good conductor coating product, such as a water-based paint as mentioned above, for example, all parts of the circuit feeding the sprayer device must in theory be insulated from ground. This is not possible if the installation is large. For example, when the paint spraying installation is part of an automobile manufacturing plant, it comprises a number of very long closed loop paint circuits which can extend right across part of the plant and which make the connections between large paint storage tanks and the various spray booths. At least one such circuit is therefore required for each coating product and another circuit of the same kind for the solvent or cleaning product. For obvious safety reasons, these circuits must be grounded. Also, in each spray booth the electrostatic sprayer devices are connected to a high-tension voltage supply. When a conductive paint is used it is therefore essential to insulate the sprayer device and the high-tension voltage supply from the parts of the structure that are necessarily grounded, in particular the product distribution circuits.

A known solution to this problem is to use an intermediate storage tank electrically insulated from ground which has a relatively small capacity and can be fed with coating product from time to time. A variable or switchable high-tension voltage source is then provided together with means for separating the intermediate storage tanks from the permanently grounded distribution circuits during coating product spraying phases.

The prior art separators for connecting or separating the pipe sections were in the open air, no precautions being taken to prevent pollution of the active parts by product lost when coupling or separating the pipe sections.

Also, as the separator must be as close as possible to the storage tank and to the sprayer to avoid wasting product on changes, it is in an area polluted by overspray and is also likely to soil the objects to be coated. What is more, despite the fact that the three components just mentioned (sprayer/storage tank/separator) are extremely close together, the system must be very compact indeed to enable it to be moved easily around the objects to be coated and so that it can very quickly be changed as a unit in the event of a fault.

An object of the invention is to achieve these three objectives, namely a compact system protected from external pollution which does not lose any product to the exterior environment.

SUMMARY OF THE INVENTION

The invention consists in an electrical insulator device in the form of a section of pipe for a circuit distributing a relatively good conductor liquid, comprising an elongate insulative casing accommodating a mobile assembly movable along an axis in said casing, an expandable pipe part of said pipe section connected between said mobile assembly and a first end of said casing, and a connection mechanism disposed in the vicinity of the second end of the casing inside the latter, axially facing said mobile assembly, the extreme position of said mobile assembly at said first end being at a predetermined distance from said connection mechanism.

The mobile parts providing the seal are in sliding rather than in face-to-face contact so that the parts soiled by the products are automatically wiped. To this end the interfaces are cylindrical, coaxial and preferably circular with the same diameter and their main relative movement is an axial translation, the products flowing radially at said interfaces. The actuator which manipulates the mobile part is of the "rodless" type with the result that the overall length is only slightly greater than the insulation distance; the insulating space is in compressed (and therefore insulative) air (Paschen's law) and the distance is smaller.

All the connecting members are inside a casing forming the body of the actuator, preventing internal and external pollution and facilitating replacement as a unit.

According to one advantageous feature of the invention, the connection mechanism constitutes an automatically closing valve mechanism.

In another aspect, the invention consists in an electrostatic spraying installation for a relatively good conductor liquid product, especially a coating product, of the type comprising a part which is grounded, for example a conductive liquid change unit, at least one intermediate storage tank insulated from ground and at least one electrostatic sprayer connected to a variable or switchable high-tension voltage supply, said intermediate storage tank being connected to feed said sprayer, which installation comprises at least one electrical insulator device forming a pipe section disposed between said intermediate storage tank and said grounded part, said pipe section is arranged in an insulative casing and includes a pipe part extending between a first end of the casing and a mobile assembly adapted to move in said casing and a connection mechanism arranged inside and in the vicinity of the second end of said casing facing said mobile assembly, which comprises means for scraping clean an end surface of said mechanism, the extreme position of said mobile assembly at said first end being at a predetermined distance from said automatic closing valve mechanism.

The invention will be better understood and other advantages of the invention will emerge more clearly from the following description given by way of example only and with reference to the appended diagrammatic drawings.

DETAILED DESCRIPTION OF THE INVENTION

Figure 1:
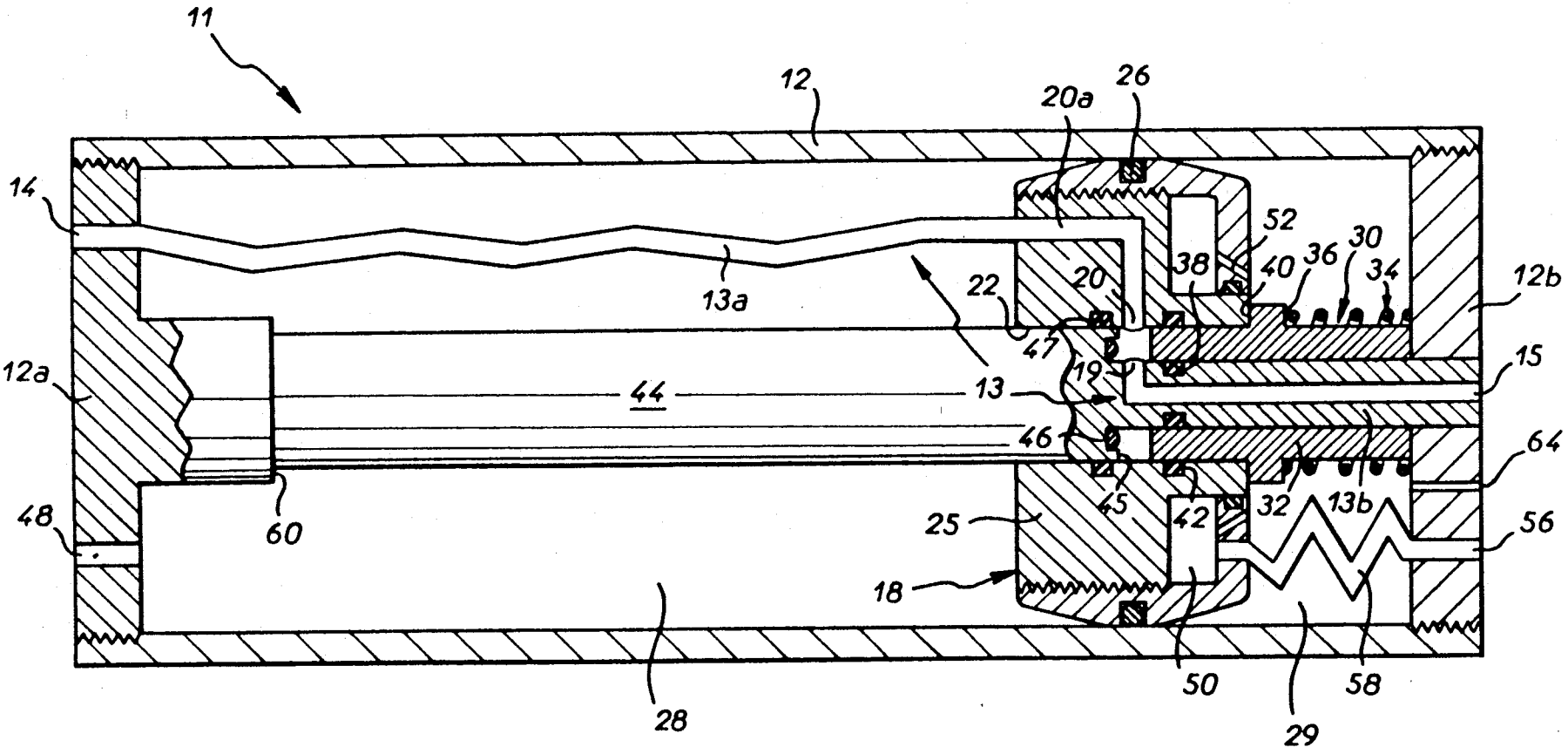
FIG. 1 is a schematic representation of an insulator device in accordance with the invention seen in longitudinal cross-section.

Referring to FIG. 1 in particular, the electrical insulator device 11 is entirely contained within an elongate cylindrical insulative casing 12. It forms a pipe section designed to be inserted into a conductive liquid circuit. The pipe section 13 is defined between a first end 12*a* of the casing at which it discharges through an orifice 14 and an opposite second end 12*b* of the same casing at which it discharges axially through an orifice 15. Said pipe section comprises an expandable, for example flexible pipe part 13*a* extending between the orifice 14 and a mobile assembly 18 and a cylindrical rigid pipe part 13*b* fixed to the second end 12*b* of the casing and extending axially within the latter. The rigid pipe part extends between the orifice 15 and at least one lateral orifice 19 inside the casing, through which it is adapted to be put into communication with said flexible pipe part 13*a* which is extended within the mobile assembly by a pipe part 20*a* to a second lateral orifice 20 discharging onto the wall of an axial bore 22 of the mobile assembly 18. The latter essentially comprises a piston 25 sliding against the cylindrical inside wall of the casing 12, to which it is sealed by an O-ring 26 in order to divide it into two actuator chambers 28, 29 adapted to be selectively supplied with compressed air to move the mobile assembly.

A connection mechanism is arranged in the vicinity of the second end 12*b* of the casing. It essentially comprises the pipe part 13*b* up to the orifice 19 and a sliding obturator 32. These components also form an automatic closing valve mechanism 30 which comprises, in addition to said rigid pipe part and said tubular sliding obturator 32 adapted to move over the external surface of the rigid pipe part 13*b*, a spring 34 adapted to urge said obturator towards a position in which it closes off said first lateral orifice 19. The spring is pre-stressed in compression between a shoulder 36 on the obturator and the end 12*b* of the casing 12. The inside diameter of the obturator matches the outside diameter of said rigid pipe part 13*b*, a seal being provided between these two parts by an O-ring 38. The valve mechanism is arranged and positioned to be opened when the mobile assembly (the piston 25) is urged towards said second end 12*b* and reaches a predetermined position (as shown in the drawings) at which the pipe parts 13*a* and 13*b* are in communication.

The inside diameter of the axial bore 22 is arranged to slide in a sealed way on the end part of the obturator 32 which comprises a shoulder 40 adapted to come into contact with the piston so that said obturator can be entrained by the piston and open said valve. A seal is provided between the surfaces of said obturator and said bore 22 by an O-ring 42 carried by the piston 25.

The rigid pipe part 13*b* is defined within a fixed insulative material axial rod 44 extending between the two ends 12*a* and 12*b* of the casing 12 and including a shoulder 45 delimiting two portions of different diameter.

The obturator 32 moves on the smaller diameter portion constituting said rigid pipe part 13*b*. The outside diameter of said obturator and that of the larger diameter portion of the rod 44 are equal so that the piston 25 can slide on either, as clearly shown in the drawing. This arrangement, and more particularly the O-ring 42, constitutes means for scraping a cylindrical end surface of the connection mechanism, i.e. the end parts of the obturator 32 and the rod 44 in the vicinity of the shoulder 45. An O-ring 46 is disposed against the shoulder 45 so as to cooperate when the valve is closed with the end of the obturator 32. An O-ring 47 carried by the piston provides a seal between the surface of the bore 22 of the piston and the surface of the larger diameter portion of the rod 44.

The actuator chamber 28 delimited between the mobile assembly 18 and the end 12*a* is supplied with compressed air through an orifice 48 in the wall of this end. The actuator chamber 29 delimited between the mobile assembly and the end 12*b* is supplied with compressed air via an air distribution cavity 50 in the piston 25 and oblique holes 52 oriented towards the surface of the rod 44. The cavity 50 is connected to an orifice 56 in said second end 12*b* by a flexible pipe 58 in the actuator chamber 29. Compressed air fed into the chamber 29 to move said mobile assembly 18 away from the valve mechanism 30 is therefore injected in such a way as to dry the outside surface of the rod 44 and therefore prevent any electrical leakage along said rod. The position of the mobile assembly 18 farthest away from the rigid pipe part 13*b* is determined by a shoulder 60 on the rod 44 in the vicinity of the end 12*a*. This extreme position at said first end is at a predetermined distance from said rigid pipe part 13*b* for which the leakage current between the pipe parts 13*a* and 13*b* remains below a given value. The end 12*b* further comprises a calibrated orifice 64 which ventilates the actuator chamber 29 to prevent excessive ionization of the air in this space. The operation of the device will now be described.

When the mobile assembly 18 is in the position shown in FIG. 1, that is to say when a fluid under pressure is fed into the actuator chamber 28, the continuity of the pipe section 13 is achieved because the piston 25 pushes the obturator 32 against the end 12*b*, which provides between said obturator and the shoulder 45 an annular space enabling communication between the orifices 19 and 20. The conductive liquid can therefore flow between the orifices 14 and 15 or vice versa. On the other hand, as soon as the air pressure in the actuator chamber 28 is removed, the obturator 32 is pushed back by the spring 34 until it abutts against the shoulder 45 and the O-ring 46, pushing back the piston 25 by the same amount. From now on the orifices 19 and 20 are separated from each other by the obturator 32 and the circulation of conductive liquid in the pipe section 13 is interrupted. Compressed air is then injected into the actuator chamber 29 through the orifice 56, the pipe 58, the distribution chamber 50 and the oblique holes 52. This moves the piston 25 towards the left as seen in FIG. 1 until it abutts against the shoulder 60. Throughout this movement the orifice 20 of the piston is closed off by the outside surface of the larger diameter portion of the rod 44. When the mobile assembly reaches its extreme position at the end 12*a* the distance between the two parts 13*a* and 13*b* is sufficient to provide the necessary electrical insulation.

Figure 2:
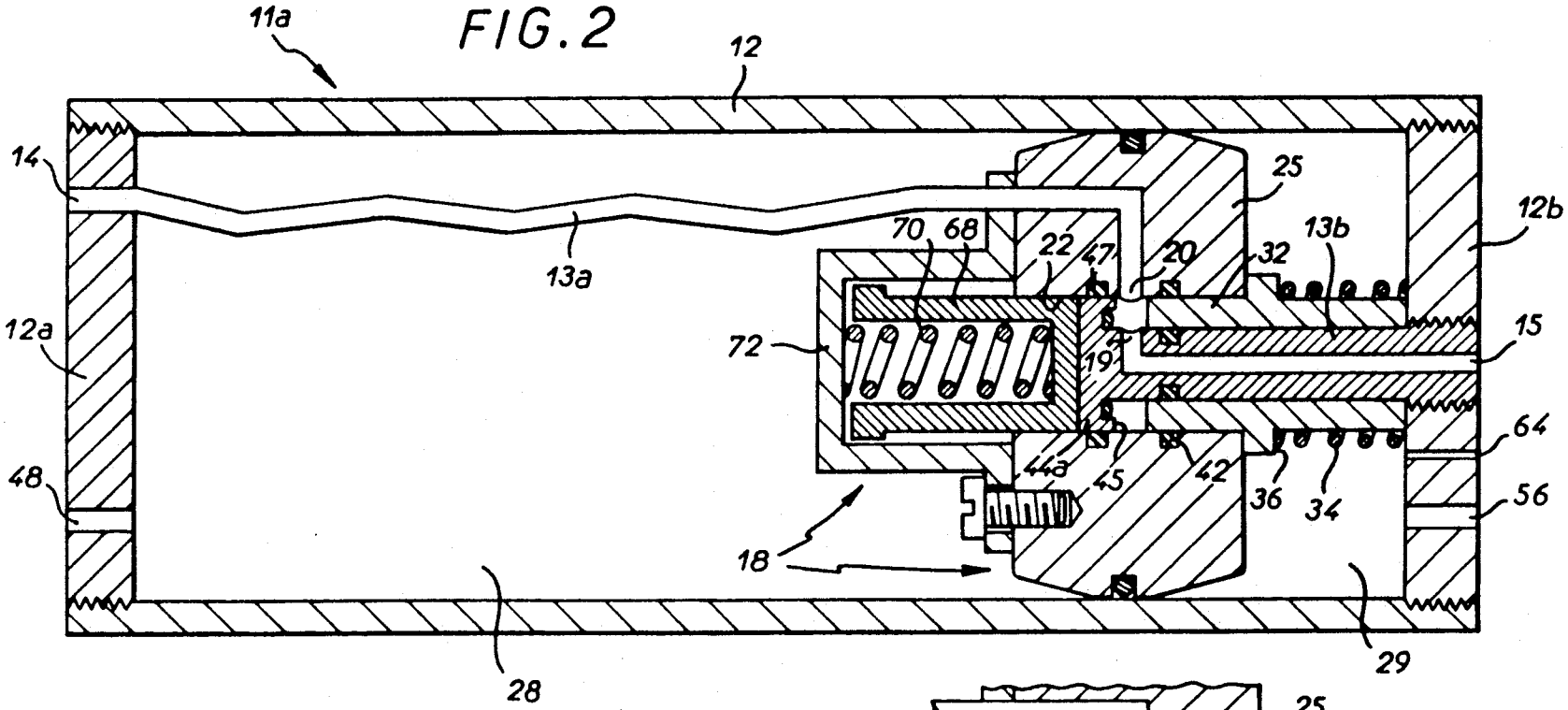
FIG. 2 shows an alternative embodiment of the device from FIG. 1.

FIG. 2 shows another embodiment of electrical insulator device 11*a* in accordance with the invention.

In FIG. 2, structural parts similar to those of FIG. 1 carry the same reference numbers and will not be described again. This second embodiment differs from the first principally by virtue of the fact that the central rod 44 (to be more precise its larger diameter portion) has been replaced with means for automatically closing off said lateral orifice 20 of the piston 25. In other words, the mobile assembly accommodates a second automatic closing valve mechanism connected to the flexible pipe part 13*a*.

Because the larger diameter portion of the rod 44 has been eliminated (strictly speaking, reduced to a very short length 44*a* providing the shoulder 45) the pipe 58, the distribution chamber 50 and the oblique holes 52 which were provided to dry the surface of said rod are also eliminated, with the result that the compressed air is introduced directly into the actuator chamber 29 through the orifice 56. As in the previous example, the O-ring 42 scrapes clean the end surface of the connection mechanism, namely the section 44*a* and the end part of the obturator 32.

The mobile assembly 18 further comprises a cylindrical valve 68 whose end is adapted to slide in the axial bore 22 of the piston 25. Said cylindrical valve is urged by a spring 70 towards the interior of the piston 25 in order to be in a position to close off said second orifice 20. The mobile assembly 18 comprises a cap 72 fixed to one side of the piston and projecting axially into the actuator chamber 28 delimited between said piston and said first 12*a*. Said cap 72 accommodates the spring 70 and part of the sliding valve 68. The spring is prestressed in compression between the cap and said valve. The cylindrical valve 68 therefore closes off the orifice 20 as soon as the piston 25 separates from said rigid pipe part 13*b*. The arrangement of the latter, combined with the valve mechanism 30, is the same as in the FIG. 1 embodiment. The end of the cap 72 comes into abutting engagement with the end 12*a* of the casing to determine the extreme position of the mobile assembly relative to the rigid pipe part 13*b*.

This second embodiment operates in exactly the same way as the previous embodiment except that the lateral orifice 20 is closed off by the cylindrical valve 68 and not by the outside surface of an axial rod 44 inside the casing.

Figure 3:
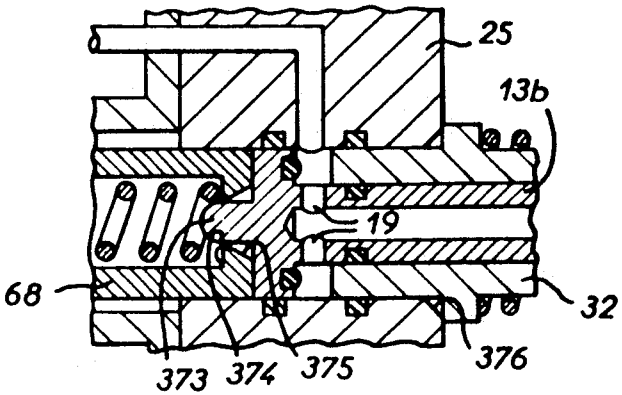
FIG. 3 shows an alternative embodiment of part of the device from FIG. 2.

FIG. 3 shows an advantageous modification to the mobile assembly from FIG. 2. The valve 68 has a central orifice 374 with an entry chamfer 375 which receives a guide nipple 373 upstanding axially from the end of the rigid pipe part 13*b*. An entry chamfer 376 on the piston 25 also facilitates the insertion of the obturator 32 into the bore in the piston.

Figure 4:
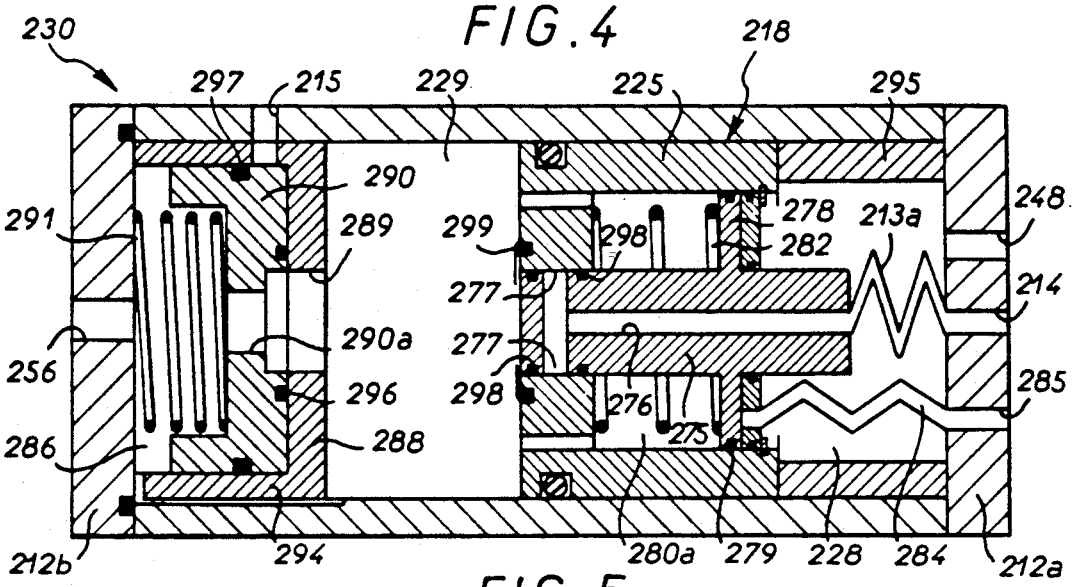
FIGS. 4 through 6 show another embodiment of the device in three different states in order to explain how it operates.
Figure 5:
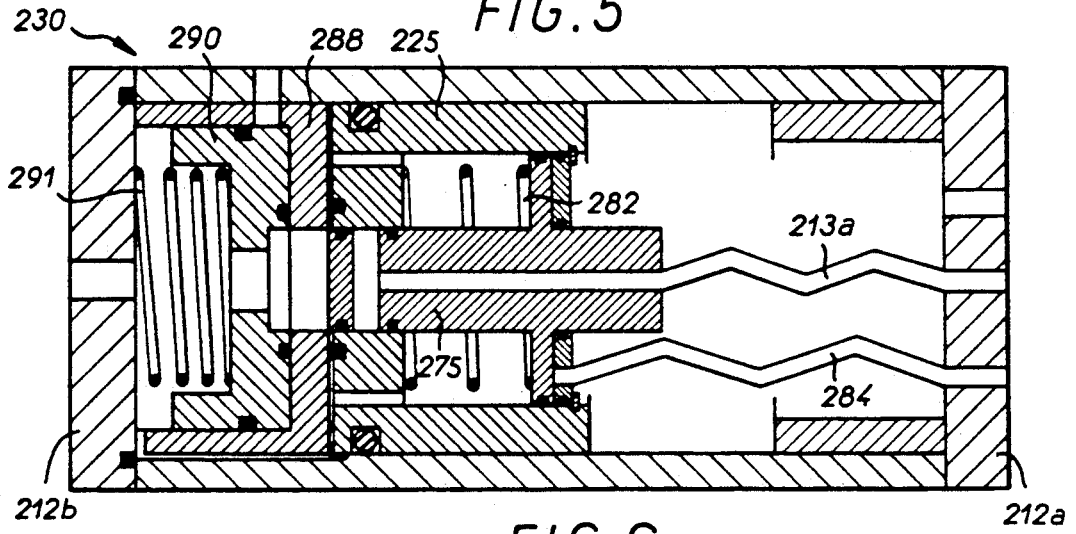
Figure 6:
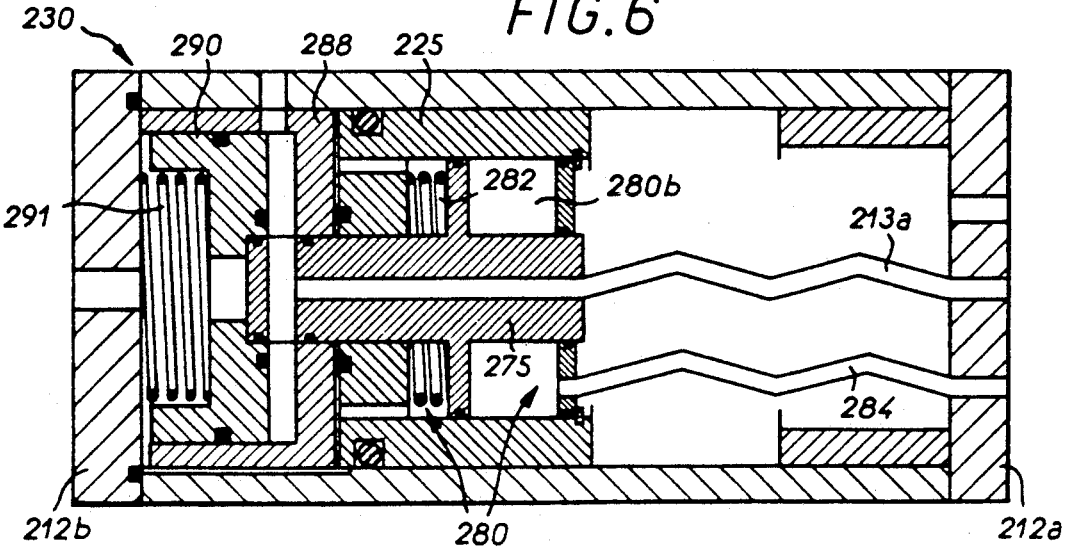

Referring to FIGS. 4 through 6, in which structural parts similar to those of FIGS. 1 and 2 carry the same reference numbers increased by 200, another embodiment is shown of the type comprising two automatic closing valve mechanisms, the first in the vicinity of said second end 212*b* and the second in said mobile assembly 218, connected to the flexible pipe part 213*a*, here joined axially.

The mobile assembly 218 includes a first piston 225 sliding against the cylindrical internal wall of the casing 212 in a sealed manner, as previously, and dividing the casing into two actuator chambers 228 and 229. The first piston 225 accommodates a second piston 275 sliding axially within the first and including a passage 276 connected to said flexible pipe part 213*a*. This passage is terminated by at least one and preferably two diametrically opposed lateral orifices 277 discharging onto the outside cylindrical surface of the piston 275. The latter is provided with an annular flange 278 sliding in a cavity 280 of said first piston 225, to which is it sealed by an O-ring 279. Said flange therefore delimits two chambers in the cavity 280. The first chamber 280*a*, communicating via bores with the chamber 229, encloses a spring 282 pre-stressed in compression to urge one side of the flange towards a position such that the orifices 277 are closed off (FIG. 4). The chamber 280*b* communicates with a control pressure source (not shown) through a flexible pipe 284 disposed in the chamber 228 between the mobile assembly and an orifice 285 in the wall 212*a*. Said second piston 275 of the mobile assembly constitutes actuator means for said first automatic closing valve mechanism 230 constituting also the aforementioned connection mechanism. This is defined in the vicinity of the second end 212*b* of the casing 212 in a fixed cylindrical cavity 286 communicating with the chamber 229. This cavity is provided with a lateral orifice 215 through which the relatively good conductor liquid passes. It comprises, facing the mobile assembly, an end wall 288 provided with an axial bore 289 whose diameter matches that of said second piston 275 of the mobile assembly, which can therefore be inserted in it. Also, the cavity 286 accommodates a piston 290 for closing off the orifice 215 and this piston is urged towards the wall 288 by a spring 291. The piston 290 can be pushed back by the second piston 275 of the mobile assembly when inserted into the fixed cavity 286 through the bore 289. The effect of this movement is to establish communication between the flexible pipe part 213*a* and the orifice 215 (FIG. 6) via the passage 276 and part of the cavity 286. The orifice 256 supplying compressed air to the chamber 229 is formed in the wall 212*b* and the cavity communicates with the chamber 229 through an axial bore 290*a* of the piston 290 and a longitudinal passage 294 extending between the wall 212*b* and the wall 288. The insulating distance is determined by the extreme position of the mobile assembly 218 away from the first valve mechanism and abutted against a cylindrical spacer 295 at the wall 212*a* end.

The orifice 215 is closed off in a sealed way by O-rings 296, 297 carried by the piston 290. The orifices 277 are closed off by two O-rings 298 carried by the piston 275 and situated to either side of the orifices 277. These two O-rings scrape clean an end surface of the connection mechanism, namely the bore 289 and the adjoining orifice of the bore 290*a*. The end face of the piston 225 carries an O-ring 299 running around the piston 277. The operation of this device will now be described.

When the device is in the state shown in FIG. 4, air pressure is established in the chamber 229 via the orifice 256, the chamber 228 being vented. The two automatic closing valve mechanisms are closed. The orifice 215 is closed off by the piston 290, the seal being provided by the O-rings 296 and 297. The orifices 277 are closed off by the piston 225, a seal being provided by the O-rings 298. The mobile assembly 218 is abutted against the spacer 295 and is therefore separated from said first valve mechanism 230 by a sufficient electrical insulation distance, predetermined in accordance with the air pressure (Paschen's law). The circulation of the relatively good conductor liquid is interrupted and electrical insulation is obtained between the orifices 214 and 215.

In the intermediate state shown in FIG. 5 the chamber 229 is vented and air pressure is established in the chamber 228 via the orifice 248. The high-tension voltage is cut off. The mobile assembly is abutted against the wall 288 of said first valve mechanism 230, through the O-ring 299. The continuity of the liquid circuit is therefore on the point of being established. In the state shown in FIG. 6, air pressure is established in the chamber 280*b* via the orifice 285 and the flexible pipe 284. The piston 275 moves, enters the bore 289 and pushes back the piston 290 until the orifices 277 and 215 communicate via an annular space created by the movement of the piston 290. The liquid can flow between the orifices 214 and 215. The air in the chamber 280*a* is evacuated through the passage 294 so that it does not impede the movement of the piston 275. When a required quantity of liquid has flowed, the same operations are repeated in the reverse order.

Figure 7:
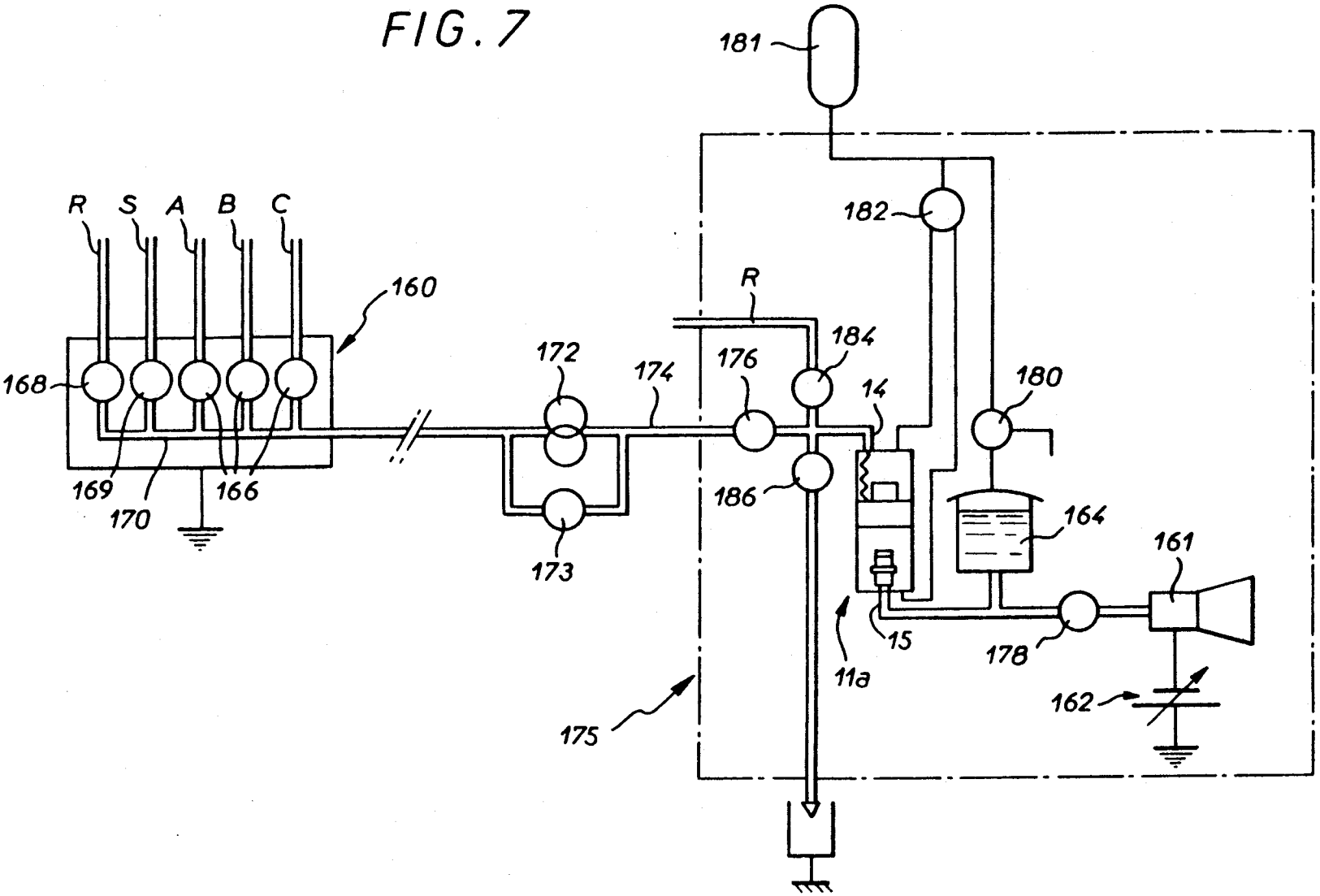
FIG. 7 is a schematic showing a coating product spraying installation incorporating an insulator device in accordance with the invention.

FIG. 7 is a schematic representation of an electrostatic spraying installation for liquid, electrically conductive coating product incorporating an insulator device as described above. This installation essentially comprises a coating product change unit 160 which is known in itself, at least one electrostatic sprayer 161 for said coating product connected to a variable or switchable high-tension voltage supply 162, an intermediate storage tank 164 adapted to store a certain quantity of coating product and an insulator device 11*a* forming a pipe section, here as in the FIG. 2 embodiment. The FIG. 1 embodiment could equally well be used or any other like device as defined hereinabove. The intermediate storage tank 164 is structurally insulated from ground.

In the conventional way the coating product change unit 160 includes selectively operable valves 166 connected to respective different coating product distribution circuits A, B, C, a selectively operable valve 168 connected to a rinsing product distribution circuit R and a selectively operable valve 169 connected to a compressed air distribution circuit S. All these valves discharge into a common manifold 170 connected to a volumetric meter 172, of the gear-pump type, for example. A selectively operable bypass valve 173 is connected in parallel with the meter 172. The outlet of the latter is connected to a flexible hose 174, usually several meters long, connected to a sprayer unit 175. The coating product change unit 160 is structurally grounded.

The hose 174 is connected to a connecting valve 176 the outlet from which is connected to the orifice 14 of the insulator device 11*a*. The orifice 15 of the device 11*a* is connected to the intermediate storage tank 164 and to the sprayer device 161 via a valve 178. Said electrical insulator device 11*a* is therefore structurally inserted between the coating product change unit 160 and the intermediate storage tank 164. The latter is a sealed and pressurized container whose upper part receives compressed air via a pressure regulator 180. A compressed air supply 181 is connected to feed the actuator chambers 28 and 29 selectively via a four-way vented valve 182. The rinsing product distribution circuit R is connected to the orifice 14 via a rinsing valve 184. A purge valve 186 for removal of waste product has its inlet connected to the same point as the rinsing valve. The three valves 176, 184 and 186 are arranged in the vicinity of the device 11*a*, as close as possible to the inlet orifice 14. The operation of this installation will now be described.

At the beginning of a cycle, air pressure is maintained in the actuator chamber 28 to ensure the continuity of the pipe section 13 within the casing 12. One of the valves 166 corresponding to a selected coating product is operated and this coating product flows through the hose 174, the valve 176 and the insulator device 11*a* and accumulates in the intermediate storage tank 164, the valve 178 being closed. During this phase the voltage from the supply 162 is reduced to zero. While the intermediate storage tank 164 is filling, the regulator 180 is in a position such that said intermediate storage tank 164 is depressurized and vented to the atmosphere.

As soon as a predetermined quantity of coating product has flowed through the meter 172 the valves 166 and 176 are closed and the valve 182 is operated so as to displace the mobile assembly 18, which causes the pipe parts 13*a* and 13*b* to be separated, as explained above. When the mobile assembly 18 reaches the end of its travel the intermediate storage tank 164 and the electrostatic sprayer device 161 are already electrically insulated from the grounded coating product change unit 160.

The intermediate storage tank 164 is then pressurized by means of the pressure regulator 180 and electrostatic spraying of the coating product can begin as soon as the valve 178 is opened and the high-tension voltage is applied. The storage tank 164 is refilled as necessary, and as long as the coating product does not need to be changed, during a short interruption of spraying, by reducing the high-tension voltage to zero and operating the insulator device 11*a*. When the coating product is to be changed, the last filling of the storage tank 164 is extended after the valve 166 is closed by opening the valve 169. The effect of this is for the air to expel virtually all of the coating product contained in the hose 174. At this time the valve 176 is closed again and the last spraying phase before the coating product change proceeds in the normal way. During this last phase, during which the intermediate storage tank 164 is progressively emptied, the coating product change unit 160, the meter 172, the valve 173, the hose 174 and the valve 176 can be sufficiently cleaned of conductive coating product by successive injection of rinsing product and compressed air as a result of successive operation of the valves 168 and 169. During injection of air the valve 173 is opened to prevent damage to the meter 172.

When the storage tank 164 is empty electrostatic spraying is interrupted and the valve 178 is closed. The pressure in the storage tank 164 is released, the two pipe parts 13*a* and 13*b* are "connected" by reversing the condition of the valve 182 and rinsing product is then injected into the device 11*a* and the intermediate storage tank 164 by operating the valve 184 (with the valve 186 closed).

The rinsing product is then expelled through the purge valve 186 (the valve 184 being closed at this time) by injecting air through the pressure regulator 180. These operations are repeated as necessary until the device 11*a* and the intermediate storage tank 164 are completely cleaned. The final stage is to clean the sprayer device 161 and the valve 178 by ejecting successively rinsing product and then air through said sprayer device. The installation is then ready to receive a new coating product by operating one of the valves 166.

There is claimed:

1. Electrical insulator device in the form of a section of pipe for a circuit distributing a relatively good conductor liquid, comprising an elongate insulative casing accommodating a mobile assembly movable along an axis in said casing, an expandable pipe part of said pipe section connected between said mobile assembly and a first end of said casing, and a connection mechanism disposed in the vicinity of the second end of the casing inside the latter, axially facing said mobile assembly, the extreme position of said mobile assembly at said first end being at a predetermined distance from said connection mechanism.

2. Device according to claim 1 wherein said connection mechanism operates by axial sliding and scraper means are provided for scraping clean the sliding surfaces in contact with said liquid.

3. Device according to claim 1 wherein said mobile assembly includes a piston sliding against and sealed to the cylindrical inside wall of said casing and dividing the latter into two actuator chambers.

4. Device according to claim 2 wherein, when continuity of said pipe section is established, the passage of said product across the connecting surfaces is substantially perpendicular to the sliding axis.

5. Device according to claim 2 wherein said scraper means comprise at least one O-ring carried by said mobile assembly and adapted to slide on a cylindrical end surface of said connection mechanism.

6. Device according to claim 5 wherein said connection mechanism constitutes a first automatic closing valve mechanism adapted to be opened when said mobile assembly, on being urged towards said second end, reaches a predetermined position at which continuity of said pipe section is established.

7. Device according to claim 6 wherein said pipe section comprises a flexible pipe part and a rigid pipe part combined with said automatic closing valve mechanism and fixed to said second end of said casing, said rigid pipe part and said flexible pipe part being placed in communication with each other when said mobile assembly reaches said predetermined position.

8. Device according to claim 7 wherein said first valve mechanism comprises:

said rigid pipe part, which is cylindrical, discharging into said casing through at least a first lateral orifice, a sliding tubular obturator for closing off said first lateral orifice adapted to move over the outside surface of said rigid pipe part, and a spring adapted to urge said obturator towards a position in which said first lateral orifice is closed off.

9. Device according to claim 8 wherein said mobile assembly includes a piston sliding against and sealed to the cylindrical inside wall of said casing and dividing the latter into two actuator chambers, and said piston includes an axial bore whose inside diameter is such that it is adapted to slide on and to be sealed to said obturator which comprises a shoulder adapted to come into contact with said piston so that said obturator can be entrained thereby and open said valve, and wherein a second lateral orifice discharges through the wall of said axial bore in order to be able to communicate with said first orifice and is connected to said flexible pipe part.

10. Device according to claim 9 wherein said rigid pipe part is defined inside a fixed adequately insulative material axial rod extending between the two ends of said casing and comprising a shoulder delimiting two different diameter portions, said sliding obturator slides on the smaller diameter portion and the outside diameter of said sliding obturator and that of the larger diameter portion of said rod are the same, so that said piston can slide on either of them.

11. Device according to claim 10 wherein said piston includes an air distribution cavity fed by a flexible pipe in the actuator chamber defined between said second end and said piston and said cavity is in communication with said actuator chamber via oblique holes oriented towards the surface of said rod.

12. Device according to claim 7 wherein said mobile assembly accommodates a second automatic closing valve mechanism connected to said flexible pipe part.

13. Device according to claim 12 wherein said mobile assembly includes: a piston sliding against and sealed to the cylindrical inside wall of said casing and dividing the latter into two actuator chambers, said piston having an axial bore; a lateral orifice which is interposed in said pipe section and discharges through the wall of said axial bore; and a cylindrical valve sliding in said axial bore in said piston and urged by a spring towards the interior of the latter in order to be able to close off said orifice.

14. Device according to claim 13 wherein said mobile assembly includes a cap fixed to one side of the piston and extending axially in the actuator chamber delimited between said piston and said first end and said cap accommodates said spring and a part of said sliding valve, said spring being pre-stressed in compression between said cap and said valve.

15. Device according to claim 13 wherein said cylindrical valve includes a central orifice adapted to receive a guide nipple upstanding axially from the end of said rigid pipe part.

16. Device according to claim 12 wherein said mobile assembly includes a first piston sliding on and sealed to the cylindrical inside wall of said casing and dividing the latter into two actuator chambers and a second piston sliding axially within the first, said second piston comprises a passage connected to said flexible pipe part and discharging through at least one orifice onto the outside lateral surface of said second piston, said second piston is provided with an annular flange sliding in a cavity in said first piston and delimiting two chambers, one chamber accommodating a spring adapted to apply a force to one side of said flange and the other chamber communicating with a source of control pressure through a flexible pipe extending between the mobile assembly and said first end of said casing, and said second piston of said mobile assembly constitutes actuator means on said first automatic closing valve mechanism.

17. Device according to claim 12 wherein said first automatic closing valve mechanism comprises a cavity arranged near the second end of said casing and provided with a lateral orifice for said relatively good conductor liquid, a wall of said cavity facing said mobile assembly comprises an axial bore whose diameter matches that of said second piston of said mobile assembly and said cavity accommodates a piston for closing off said orifice, urged by a spring towards said wall and adapted to be pushed back by said second piston of said mobile assembly into said fixed cavity and so place said flexible pipe part in communication with said lateral orifice of said cavity.

18. Device according to claim 17 wherein said fixed cavity includes an orifice adapted to be connected to a control pressure source and said cavity communicates with one of the actuator chambers.

19. Installation for electrostatically spraying a relatively good conductor liquid product, especially a coating product, comprising a grounded part, for example a conductive liquid change unit, at least one intermediate storage tank insulated from ground and at least one electrostatic sprayer connected to a variable or switchable high-tension voltage supply, said intermediate storage tank being connected to feed said sprayer, which installation comprises at least one electrical insulator device forming a pipe member disposed between said intermediate storage tank and said grounded parts, said pipe section is arranged in an insulative casing and includes a pipe part extending between a first end of said casing and a mobile assembly adapted to move in said casing and a connection mechanism arranged inside and in the vicinity of the second end of said casing facing said mobile assembly, which comprises means for scraping clean an end surface of said mechanism, the extreme position of said mobile assembly at said first end being at a predetermined distance from said automatic closing valve mechanism.

20. Device according to claim 1 wherein said connection mechanism constitutes a first automatic closing valve mechanism adapted to be opened when said mobile assembly, on being urged towards said second end, reaches a predetermined position at which continuity of said pipe section is established.

21. Device according to claim 20 wherein said pipe section comprises a flexible pipe part and a rigid pipe part combined with said automatic closing valve mechanism and fixed to said second end of said casing, said rigid pipe part and said flexible pipe part being placed in communication with each other when said mobile assembly reaches said predetermined position.

22. Device according to claim 21 wherein said first valve mechanism comprises:

said rigid pipe part, which is cylindrical, discharging into said casing through at least a first lateral orifice, a sliding tubular obturator for closing off said first lateral orifice adapted to move over the outside surface of said rigid pipe part, and a spring adapted to urge said obturator towards a position in which said first lateral orifice is closed off.

23. Device according to claim 21 wherein said mobile assembly accommodates a second automatic closing valve mechanism connected to said flexible pipe part.

* * * * *